US006687965B2

(12) United States Patent
D'Arrigo

(10) Patent No.: US 6,687,965 B2
(45) Date of Patent: Feb. 10, 2004

(54) APPARATUS FOR SETTING ARMATURE/ NEEDLE LIFT IN A FUEL INJECTOR

(75) Inventor: Angelo D'Arrigo, Newport News, VA (US)

(73) Assignee: Siemens Automotive Corporation, Auburn Hills, MI (US)

( * ) Notice: Subject to any disclaimer, the term of this patent is extended or adjusted under 35 U.S.C. 154(b) by 0 days.

(21) Appl. No.: 10/101,335

(22) Filed: Mar. 20, 2002

(65) Prior Publication Data

US 2003/0084571 A1 May 8, 2003

Related U.S. Application Data

(62) Division of application No. 09/606,160, filed on Jun. 29, 2000, now Pat. No. 6,385,848.

(51) Int. Cl.[7] ..... B21K 1/20

(52) U.S. Cl. ..... 29/235; 29/283.5; 29/237; 72/402

(58) Field of Search ..... 72/402; 29/283.5, 29/237, 238, 234, 235, 252

(56) References Cited

U.S. PATENT DOCUMENTS 443,030 A * 12/1890 Wood ..... 72/402
3,418,708 A 12/1968 Siver
3,608,171 A 9/1971 Stradtmann
3,645,126 A * 2/1972 Kralowetz et al. ..... 72/402
4,461,163 A * 7/1984 Kralowetz ..... 72/402
4,539,164 A * 9/1985 Roberts ..... 261/114.2
4,602,413 A 7/1986 Krauss et al.
4,610,080 A 9/1986 Hensley
4,938,451 A 7/1990 Weaver et al.
4,974,312 A 12/1990 Yokoyama et al.
5,127,624 A 7/1992 Domke
5,178,362 A 1/1993 Vogt et al.
5,390,411 A 2/1995 Vogt et al.
5,715,723 A * 2/1998 Owens ..... 72/402
5,996,910 A 12/1999 Takeda et al.
6,044,547 A 4/2000 Cuevas et al.
6,056,263 A 5/2000 Stier
6,178,802 B1 * 1/2001 Reynolds ..... 72/402

* cited by examiner

*Primary Examiner*—Robert C. Watson

(57) ABSTRACT

A method of setting a distance between a first body and a second body in a fuel injector is disclosed. The method includes providing an intermediate body having a first end, a second end and a longitudinal axis, the first end being fixedly connected to the first body and the second end being fixedly connected to the second body. The intermediate body is compressed toward the longitudinal axis. The compression axially elongates the intermediate body, such that the first body is separated from the second body. An apparatus used to set the distance is also disclosed.

4 Claims, 3 Drawing Sheets

APPARATUS FOR SETTING ARMATURE/ NEEDLE LIFT IN A FUEL INJECTOR

CROSS-REFERENCE TO RELATED APPLICATIONS

The present application is a divisional application filed pursuant to 35 U.S.C. §§120 and 121 and claims the benefits if prior application Ser. No. 09/606,160 filed Jun. 29, 2000, now U.S. Pat. No. 6,385,848, which is hereby incorporated by reference in its entirety.

FIELD OF THE INVENTION

The present invention is directed to a method of setting armature/needle lift in a fuel injector by plastic deformation of a structural component of the fuel injector.

BACKGROUND OF THE INVENTION

Fuel injectors are commonly employed in internal combustion engines to provide precise metering of fuel for introduction into each combustion chamber. Additionally, the fuel injector atomizes the fuel during injection, breaking the fuel into a large number of very small particles, increasing the surface area of the fuel being injected and allowing the oxidizer, typically ambient air, to more thoroughly mix with the fuel prior to combustion. The precise metering and atomization of the fuel reduces combustion emissions and increases the fuel efficiency of the engine.

An electro-magnetic fuel injector typically utilizes a solenoid assembly to supply an actuating force to a fuel metering valve. Typically, the fuel metering valve is a plunger style needle valve which reciprocates between a closed position, when the needle is seated in a valve seat along a sealing diameter to prevent fuel from escaping through a metering orifice disc into the combustion chamber, and an open position, where the needle is lifted from the valve seat, allowing fuel to discharge through the metering orifice for introduction into the combustion chamber.

Accurate lift set for the needle is important because the lift height affects the static flow of fuel through the injector. The previously known process of "direct lift set" requires very accurate machines and metering components, and special geometry between a lower subassembly and an upper subassembly of the injector to form a "lock" which holds the relative positions of the assemblies during connection of the subassemblies. The lower subassembly is generally comprised of a valve body, a seat/guide assembly, and an armature/needle assembly. The upper subassembly is generally comprised of a coil, an inlet tube, a housing, a non-magnetic shell, and a valve body shell.

The upper and lower subassemblies are pressed together to set the lift, with the interface occurring between the valve body and the valve body shell. This press involves shearing metal, causing a "chip" to shear off the valve body shell into a groove in the valve body. When attempting to push the two subassemblies together, the motion required to force the desired relationship is quite variable. For example, a 1000 Newton force may cause no motion, but a 1005 Newton force may cause the subassemblies to move 100 microns with respect to each other. It is seen, therefore, that control of the relative motions is difficult. For example, if the tooling used to set the lift pushes the subassemblies 20 microns closer together, the individual parts in each subassembly may compress some unknown amount, and the relative position of the parts may move some other, also unknown, amount. There is no absolute control of the relative positions of the parts, which makes direct lift setting a less than perfect process.

It would be beneficial to develop a method of setting lift height by a method that ensures producing the desired lift height.

BRIEF SUMMARY OF THE INVENTION

Briefly, the present invention provides a method of setting a distance between a first body and a second body. The method comprises providing an intermediate body having a first end, a second end and a longitudinal axis, the first end being fixedly connected to the first body and the second end being fixedly connected to the second body; and compressing the intermediate body toward the longitudinal axis and axially elongating the intermediate body, the first body being separated from the second body.

Further, the present invention provides a method of setting armature/needle lift in a fuel injector. The method comprises providing a non-magnetic shell having a first end, a second end and a longitudinal axis; fixedly connecting the first end with a first subassembly; inserting an second subassembly into the second end, the second subassembly engaging the first subassembly; fixedly connecting the second subassembly to the non-magnetic shell; and compressing the non-magnetic shell toward the longitudinal axis and axially elongating the non-magnetic shell, the first subassembly being separated from the second subassembly.

Additionally, the present invention provides an armature/needle assembly lift setting apparatus. The apparatus comprises a plurality of punches. Each punch has a longitudinal axis intersecting at a common point and a contact end. The apparatus also includes an interior perimeter generally formed by the engagement ends of the plurality of punches. The interior perimeter is sized to accept a working piece therein, with the working piece including a working piece longitudinal axis. The apparatus also includes an actuator operatively connected to the plurality of punches such that operation of the actuator moves each of the plurality of punches along each respective longitudinal axis. The engagement end of each of the plurality of punches engages the working piece and compresses the working piece in a plane of the longitudinal axes and lengthens the working piece along the working piece longitudinal axis.

Additionally, the present invention provides a fuel injector comprising an upstream end body having an inlet tube, a downstream body having a valve body, and a longitudinal axis extending therethrough. The fuel injector also includes a hollow shell having a first end connected to the inlet tube, a second end connected to the valve body, and a central portion therebetween being plastically deformable toward the longitudinal axis, such that the hollow shell elongates along the longitudinal axis to separate the upstream end from the downstream end.

BRIEF DESCRIPTION OF THE DRAWINGS

The accompanying drawings, which are incorporated herein, and constitute part of this specification, illustrate the presently preferred embodiments of the invention, and, together with the general description given above and the detailed description given below, serve to explain the features of the invention. In the drawings.

DETAILED DESCRIPTION OF THE PREFERRED EMBODIMENT

Figure 1:
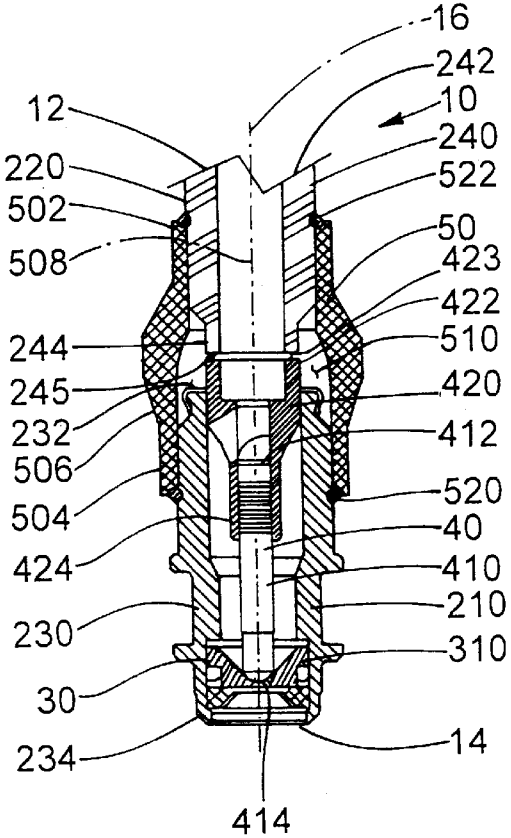
FIG. 1 is a side profile view, in section, of a portion of a fuel injector manufactured according to a preferred embodiment of the present invention.

FIG. 1 shows a side profile view, in section, of a portion of a portion of a fuel injector 10 having an upstream end 12, a downstream end 14, and a longitudinal axis 16 extending therethrough, according to a preferred embodiment of the present invention. As used herein, like numbers indicate like elements throughout. Only the relevant portions of the fuel injector 10 will be shown and discussed, as those skilled in the art will recognize the interrelationship of these portions with the remaining, unshown portions of the fuel injector 10.

The fuel injector 10 includes a downstream body or subassembly 210, and an upstream body or subassembly 220. As used herein, the term "upstream" is defined to mean a direction toward the top of the figures, and "downstream" is defined to mean a direction toward the bottom of the figures. The downstream subassembly 220 is comprised of a valve body 230 which has an upstream end 232 and a downstream end 234. The downstream subassembly 220 is also comprised of a seat/guide assembly 30, and an armature/needle assembly 40, which are located within the valve body 230. The upstream subassembly 220 is comprised of an inlet tube 240. The downstream subassembly 210 the upstream subassembly 220 and the elements comprising the downstream subassembly 210 and the upstream subassembly 220 are all located coaxial with the longitudinal axis 16.

The seat/guide assembly 30 includes a generally frusto-conical valve seat 310 located proximate to the downstream end 14 of the injector 10. The armature/needle assembly 40 includes a needle 410 which has an upstream end 412 and a downstream end 414. The downstream end 414 of the needle 410 is shaped and configured for a sealing engagement with the frusto-conical valve seat 310 when the needle is in a closed position, as will be described in more detail. The armature/needle assembly 40 also includes an armature 420, which has an upstream end 422 having a contact face 423, and a downstream end 424. The downstream end 424 of the armature 420 is fixedly connected to the upstream end 412 of the needle 410, so that the needle 410 and the armature 420 operate together as the armature/needle assembly 40.

The inlet tube 240 includes an upstream end 242 and a downstream end 244. The downstream end 244 includes a contact face 245 which contacts the contact face 423 on the armature 420, as will be described in more detail herein.

The injector 10 also includes an intermediate body 50, which connects the upstream end 232 of the valve body 230 with the downstream end 244 of the inlet tube 240. Preferably, the intermediate body 50 is a non-magnetic hollow shell. Preferably, the intermediate body 50 is constructed from austenitic steel, and more preferably 304L austenitic steel, although those skilled in the art will recognize that other, plastically deformable materials can be used. Preferably, the intermediate body 50 is connected to the valve body 230 with a weld 510 and to the inlet tube 240 with a weld 520.

The intermediate body 50 includes an upstream end 502, a downstream end 504, a central portion 506, and a longitudinal axis 508 which is co-axial with the injector longitudinal axis 106. Preferably, the body 50 is generally tubular, with a longitudinal channel 510 extending therethrough, generally co-axial with the longitudinal axis 508. Preferably, the longitudinal channel 510 tapers generally outwardly through the central portion 506, so that the longitudinal channel 510 is generally larger in the downstream portion 504 than in the upstream portion 502. Additionally, the wall of the central portion 506 is preferably thicker than the walls of either the upstream or the downstream portions 502, 504, respectively. The thicker central portion 506 provides a rigid support between the valve body 203 and the inlet tube 240 and improves the structural integrity of the fuel injector 10. Preferably, the downstream end face 246 of the inlet tube 240 and the contact face 423 of the armature 420 engage each other within the central portion 506.

Figure 2:
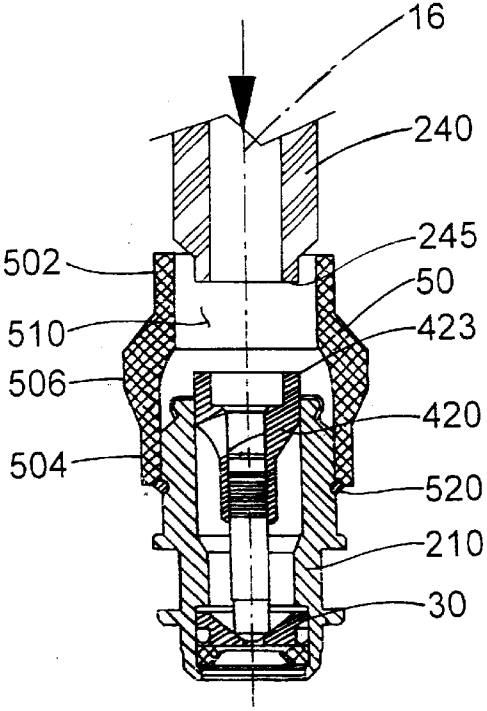
FIG. 2 is a side profile view, in section, of an inlet tube being inserted into a non-magnetic shell in the fuel injector shown in FIG. 1.
Figure 3:
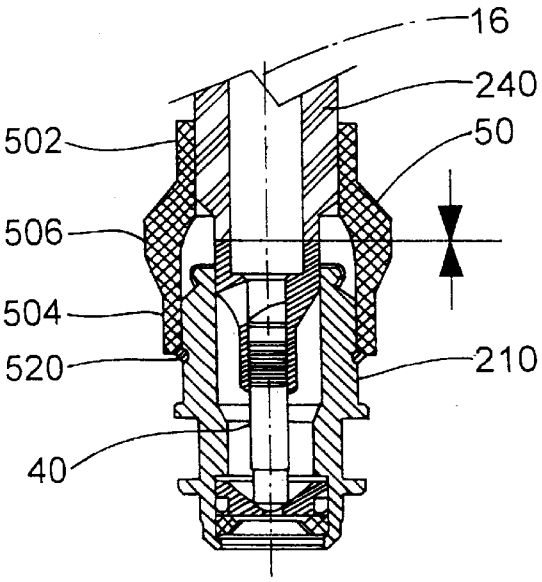
FIG. 3 is a side profile view, in section, of the inlet tube having been fully inserted into the non-magnetic shell.
Figure 4:
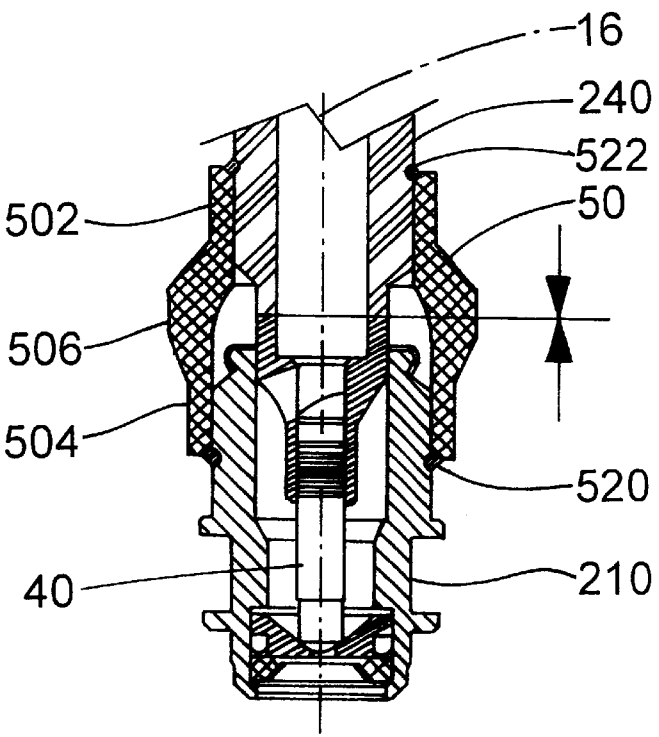
FIG. 4 is a side profile view, in section, of the inlet tube having been fixedly connected to the non-magnetic shell.

The process for setting the lift of the armature/needle assembly 40 is as follows. The seat assembly 30 is inserted into and fixedly connected to the downstream end 234 of the valve body 230. The armature/needle assembly 40 is inserted into the upstream end 232 of the valve body 230. The downstream end 412 of the needle 410 is engaged with the valve seat 310, as the needle 410 would be engaged with the valve seat 310 in a closed position. The intermediate body 50 is lowered over the upstream end 232 of the valve body 230 and secured to the valve body with weld 520. As shown in FIGS. 2 and 3, the downstream end 244 of the inlet tube 240 is inserted into the intermediate body 50 until the downstream end face 246 engages the armature contact face 423. The armature/needle assembly 40 is kept firmly against the valve seat 310 in this position for a predetermined amount of time in order to minimize settlement movement between the parts involved in this insertion operation. With the inlet tube 240 pressed against the armature/needle assembly 40 in order to minimize any settling movement between the parts, the downstream end 244 of the inlet tube 240 is then connected to the intermediate body by weld 522, as shown in FIG. 4. Although welds 520, 522 are the preferred means of connecting the intermediate body 50 to the inlet tube 240 and valve body 230, respectively, those skilled in the art will recognize the other methods of permanently connecting the intermediate body 50 to the inlet tube 240 and the valve body 230, respectively, such as furnace brazing, swaging, gluing, interference fit, or any other process typically used to permanently join the intermediate body 50 to the inlet tube 240 and the valve body 230 can be used.

Figure 5:
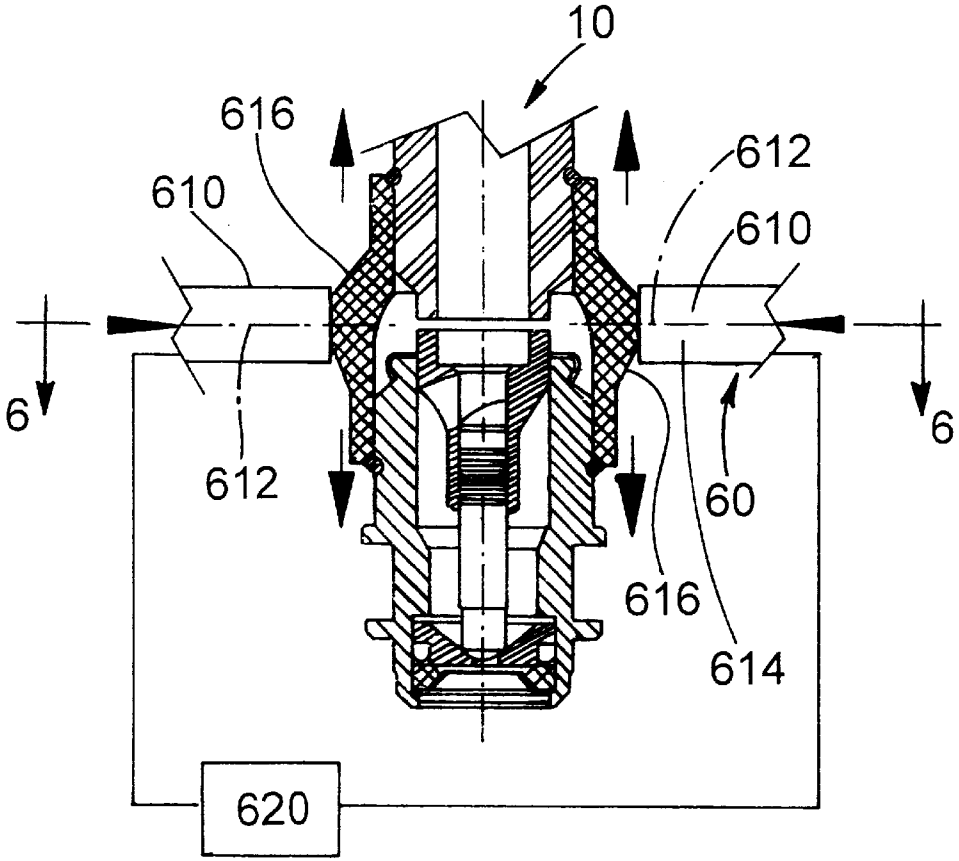
FIG. 5 is a side profile view, in section, of the non-magnetic shell being compressed by a lift setting apparatus to separate the inlet tube from an armature/needle assembly in the fuel injector.
Figure 6:
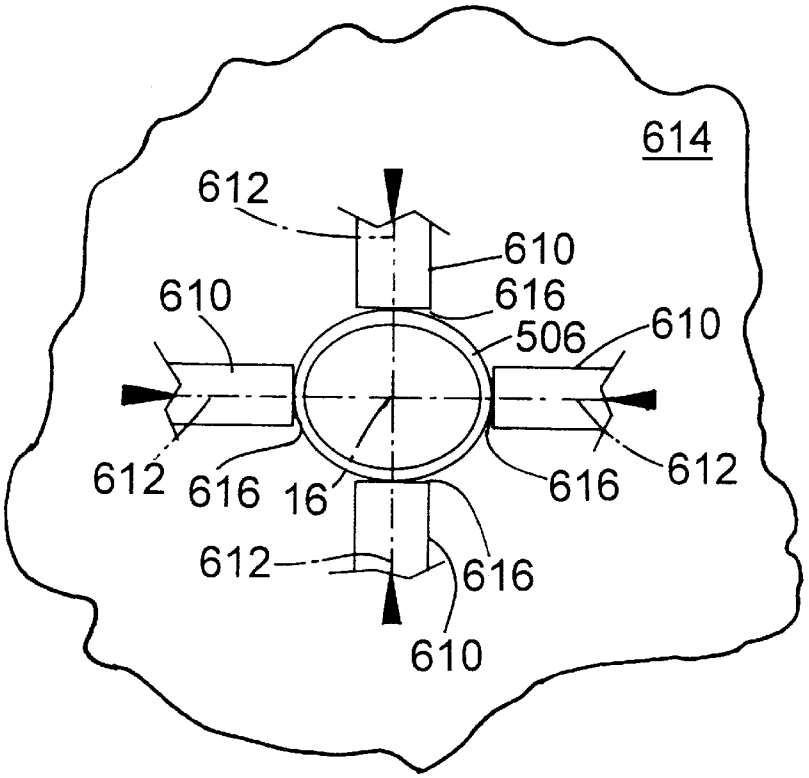
FIG. 6 is a sectional view of the non-magnetic shell and the lift setting apparatus taken along line 6—6 of FIG. 5.

After the connection of the inlet tube to 240 to the intermediate body 50 is complete, the lift setting is performed. The portion of the fuel injector 10 is inserted into a lift setting apparatus 60, as shown in FIG. 5. The lift setting apparatus 60 preferably includes four punches 610 which are generally symmetrically spaced about the longitudinal axis 16 ninety degrees apart from each other, as shown in FIG. 6, although those skilled in the art will recognize that more or less than four punches 610 can be used. Each of the four punches 610 includes a longitudinal axis 612, which are all generally perpendicular to the longitudinal axis 16 of the injector 10 when the injector 10 is inserted into the lift setting apparatus 60, and which intersect at the longitudinal axis 16. The longitudinal axes 612 form a contact plane 614. As can be seen from FIG. 5, the contact plane 614 is preferably along, or at least proximate to, the location of contact between the downstream end face 246 of the inlet tube 240 and the contact face 423 of the armature 420. Each punch 610 also includes a contact face 616 which engages the fuel injector 10 during the lift setting operation. Prior to starting the lift setting operation, the punches 610 are generally spaced apart from each other so as to form an interior perimeter 618 which is sized to accept the portion of the fuel injector 10. The portion of the fuel injector 10 is aligned with the punches 612 such that the intermediate body 50 is aligned in the contact plane 614.

Figure 7:
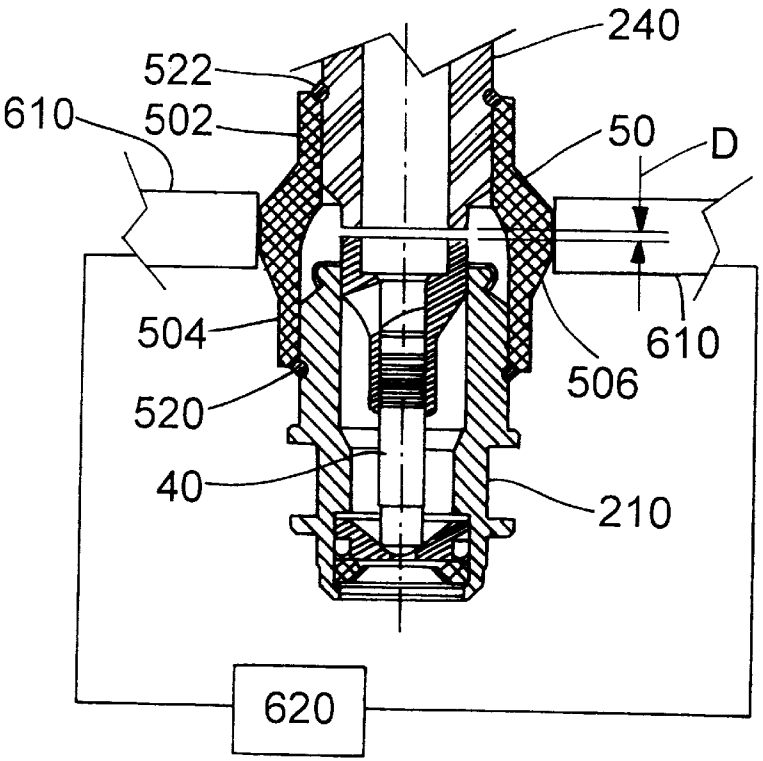
FIG. 7 is a side profile view, in section, of the non-magnetic shell after being compressed by the lift setting apparatus to separate the inlet tube from the armature/needle assembly.

When the lift setting operation is commenced, an actuator 620, which is operatively connected to the punches 610, moves the punches 610 perpendicularly to and toward the longitudinal injector axis 16. The contact faces 616 on each punch 610 engage the central portion 506 of the intermediate body 50 and compress the central portion 506 along the contact plane 614 toward the longitudinal axis 106 in a crimping-type manner. This crimping operation plastically deforms the central portion 506 of the intermediate body 50 and elongates the intermediate body 50 along the longitudinal axis 106 a predetermined amount, as shown in FIG. 7, separating the inlet tube 240 from the armature/needle assembly 40. The predetermined amount of the elongation is the value of the desired lift distance for the armature/needle assembly 40.

In order to guarantee a desired and repeatable lift as a result of the crimping operation, the punches 610 can be set to travel a preset stroke distance, or to contact the intermediate body 50 with a predetermined load. In order to verify the lift of the armature/needle assembly 40, the armature/needle assembly 40 can be operated using a slave coil (not shown) with the lift amount being measured. In the event that the lift that is developed is not enough to meet the desired lift, the portion of the fuel injector 10 can be reinserted in the lift setting apparatus 60. The stroke distance or the applied load can be reset and the punches 610 can be reapplied to the central portion 506 of the intermediate body 50 to further plastically deform the intermediate body 50 and increase the lift.

Although the plastic deformation of the intermediate body 50 is preferably performed by the punches 610, those skilled in the art will recognize that the deformation can be performed with any other symmetrical physically controlled force.

It will be appreciated by those skilled in the art that changes could be made to the embodiment described above without departing from the broad inventive concept thereof. It is understood, therefore, that this invention is not limited to the particular embodiment disclosed, but it is intended to cover modifications within the spirit and scope of the present invention as defined in the appended claims.

What is claimed is:

1. An apparatus for lift setting of an armature/needle of fuel injector extending along a central axis and having an upstream body, a downstream body, and an intermediate body, wherein an upstream end of the intermediate body is connected to the upstream body and a downstream end of the intermediate body is connected to the downstream body, the upstream end having an inlet tube, the downstream end having a valve body with a seat and an armature disposed in the valve body, the apparatus comprising:

a subassembly of the fuel injector including a deformable intermediate body affixed to the upstream body and the downstream body so that the bodies are fixed in relation to each other along a central axis;

a plurality of punches, each punch having a longitudinal axis and a contact end, the respective longitudinal axes intersecting at a common point, each of the contact ends contiguous to a circumferential outer surface of the deformable intermediate body; and an actuator operatively connected to the plurality of punches such that operation of the actuator moves each of the plurality of punches along each respective longitudinal axis so that the contact end of each of the plurality of punches compresses the deformable intermediate body in a plane of the longitudinal axes and plastically elongates the deformable intermediate body along the central axis to provide a working gap between the first end of the upstream body and the surface of the armature in the downstream body.

2. The apparatus according to claim 1, wherein each of the plurality of punches applies a predetermined load to the deformable intermediate body.

3. The apparatus according to claim 1, wherein each of the plurality of punches is actuable a predetermined distance to the deformable intermediate body.

4. The apparatus of claim 1, wherein the deformable intermediate body comprises a central portion having a greater diameter than an upstream end or downstream end of the deformable intermediate body.

* * * * *